US007073689B2

(12) United States Patent
Eglmeier et al.

(10) Patent No.: US 7,073,689 B2
(45) Date of Patent: Jul. 11, 2006

(54) DISPENSER WITH A METERING DEVICE

(75) Inventors: Hans Eglmeier, Nuremberg (DE); Oliver Kleinert, Nuremberg (DE)

(73) Assignee: Hilti Aktiengesellschaft, Schaan (LI)

( * ) Notice: Subject to any disclaimer, the term of this patent is extended or adjusted under 35 U.S.C. 154(b) by 574 days.

(21) Appl. No.: 10/606,338

(22) Filed: Jun. 25, 2003

(65) Prior Publication Data

US 2004/0065692 A1 Apr. 8, 2004

(30) Foreign Application Priority Data

Jul. 2, 2002 (DE) ..... 102 29 731

(51) Int. Cl.
*B65D 88/54* (2006.01)

(52) U.S. Cl. ..... 222/309; 222/389

(58) Field of Classification Search ..... 222/309, 222/389

See application file for complete search history.

(56) References Cited

U.S. PATENT DOCUMENTS 3,095,125 A * 6/1963 Bundy ..... 222/309
5,020,693 A * 6/1991 Ernst et al. ..... 222/389

* cited by examiner

*Primary Examiner*—Philippe Derakshani
(74) *Attorney, Agent, or Firm*—Abelman, Frayne & Schwab

(57) ABSTRACT

A dispenser for dispensing a substance includes a metering device (4) for presetting a metered amount of the substance to be dispensed by the dispensing device (2), and having an adjustment member (11) for adjusting the metered amount, an entrain member (12) cooperating with the press-out member (3), a return device (10) for displacing the entrain member from an end position thereof to an initial position thereof, and a return device (10) for displacing the entrain member from an end position thereof to an initial position thereof, and a movement converter (13) for pivoting the entrain member (12) relative to the housing (1) in response to displacement of the press-out member in the longitudinal direction (L).

12 Claims, 4 Drawing Sheets

DISPENSER WITH A METERING DEVICE

BACKGROUND OF THE INVENTION

1. Field of the Invention

The present invention relates to a dispenser for dispensing a substance, in particular, a pneumatic dispenser including a housing, a dispensing device located in the housing and having an elongate press-out member for ejecting the substance and supported in the housing for displacement in a longitudinal direction, and a metering device for presetting a metered amount of the substance to be dispensed by the dispensing device and having an adjustment member for adjusting the metered amount, an entrain member cooperating with the press-out member, and a return device for displacing the entrain member from its end position to its initial position.

2. Description of the Prior Art

Dispensers of the type described above are used for delivering a metered amount of a substance, e.g., from a cartridge or a bag. The substance can consist of one or more components stored in one or several cartridges. The dispenser includes a housing, a dispensing device, and a metering device. In the housing, there is provided space for receiving one or more cartridges from which a substance is dispensed, in particular, is press-out or ejected. At certain applications, e.g., with chemical dowels, the dispensed amount of the substance is defined by the requirements of a used chemical dowel. The metering device permits the user to dispense, in a time-saving manner, a precise amount, e.g., for filling a bore. For adjusting the metered amount of a substance, the metering device includes an adjustment member.

U.S. Pat. No. 5,020,693 discloses a pneumatic dispenser including a housing, a dispensing device for storing and delivering a substance and having an elongate press-out member, a metering device for preliminary selecting a metered amount of the substance to be dispensed by the dispensing device and an actuation mechanism for actuating the dispensing device. The metering device has a return device, an adjustment member for adjusting the metered amount, and an entrain member which cooperates with the press-out member and is displaced from its end position to its initial position by the return device. The press-out member is supported in the housing for a longitudinal displacement therein. The press-out member has a plurality of piston rods for ejecting, e.g., a cartridge filled with a substance. The metering device is provided with at least one stop provided on the housing and displaceable in the longitudinal direction of the press-out member securable with a locking screw.

The drawback of the metering device of U.S. Pat. No. 5,020,693 consists in that the screwed-down stop is displaced at least somewhat by the return device, whereby the predetermined metered amount of the substance can be changed.

A further drawback of the metering device of U.S. Pat. No. 5,020,693 consists in that the adjustment member does not insure a convenient and sufficiently precise adjustment of the metered amount.

Accordingly, an object of the present invention is to provide a dispenser that can be economically manufactured and, at the same time, would insure a precise and convenience adjustment of the metered amount.

Another object of the present invention is to provide a dispenser in which an undesirable change of the metered amount is prevented.

SUMMARY OF THE INVENTION

These and other objects of the present invention, which will become apparent hereinafter, are achieved by providing in a metering device of the type described above, a movement converter that upon displacement of the press-out member in a longitudinal direction, pivots the entrain member relative to the housing.

The pivotal movement of the entrain member in response to the longitudinal displacement of the press-out member insures precise metering of the substance. Dependent on the application and basic conditions, the dispenser and, in particular, the movement converter is so designed that a sufficiently precise metering of a substance is insured. Thus, at small amounts, the movement converter adjusts the return path, which is determined by the displacement of the press-out member, so that it corresponds to the metered amount. Thereby, it is insured that a rotational movement of the entrain member corresponds to the amount of the ejected substance. Advantageously, the entrain member pivots or rotates in a predetermined angular region. This insures a compact structure of the dispenser and, in particular, of the metering device.

Advantageously, the movement converter has a helical shaft and a nut which is secured to the press-out member and with which the helical shaft cooperates. Forming the movement converter of a helical shaft and a nut insures an economical manufacture of the movement converter. With the translational movement of the press-out member, the two parts, the helical shaft rotates relative to the nut dependent on the return path of the press-out member, providing for rotation of the entrain member.

According to the invention, the entrain member has a rest stop defining an initial position of the entrain member, and an end stop for actuating the return device. The rotational angle between the rest and end stops determines the metered amount. During the ejection step when a metered amount of a substance is ejected by the press-out member, the entrain member pivots from its initial position until it is stopped by the end stop. Dependent on the conversion ratio between the rotational movement of the entrain member and the translational movement of the press-out member, which is preset by the movement converter, the rotational angle of the entrain member, which rotates synchronously with the displacement of the press-out member in the longitudinal direction, is determined by the travel path of the press-out member. When the entrain member reaches the end stop, the return device is actuated, which results in a pivotal movement of the entrain member to its initial position, without a need in displacement of the press-out member in the longitudinal direction.

In order to insure an economical manufacturing of the metering device, advantageously, the rest stop and the end stop are pivoted relative to each other by the adjustment member. The angular position of the rest and end stops relative to each other determines the metered amount of a substance. By pivoting the rest and end stops relative to each other, the metered amount is adjusted.

In order to provide for economical manufacturing of the metering device and to insure a long service life, the end stop is provided, advantageously, on the entrain member.

Advantageously, the rest stop is rotatably supported on the housing, which insures a convenient and precise adjustment of the metering device.

Advantageously, the metering device has a wrap spring which is rotatably supported in the housing and functions as a counter stop for the rest stop.

In order to insure an easy pivotability of the rest stop of the entrain member, the wrap spring is rotatable by the adjustment member upon an application of a tensile load to the spring. After being rotated, the wrap spring refixes itself in its position by its own spring force which causes a radial expansion of the spring and thus its locking in position.

Advantageously, the wrap spring has a substantially cylindrical outer contour and is mounted in a bore in the housing. Advantageously, the spring is pressed into contact with the rest stop. This insures self-locking of the wrap spring under a load and prevents the undesired displacement of the rest stop relative to the housing.

Advantageously, the movement converter includes a compression coupling which is provided between the press-out member and the entrain member.

According to the invention, the compression coupling has a coupling shaft rotatable in response to displacement of the press-out member, a coupling member supported on the coupling shaft for joint rotation therewith, and a mating coupling member connectable with the coupling member and connected with the entrain member for joint rotation therewith.

Advantageously, the mating coupling member has a diaphragm engageable, at least regionwise, with the coupling member and arranged, at least partially, in a pressure chamber formed in the housing.

The arrangement of the diaphragm, which forms a part of the compression coupling, provides for a coupling condition of the compression coupling when an overpressure is produced in the compression chamber. This design of the compression coupling is particularly advantageous when the compression coupling is used in a pneumatic dispenser.

The novel features of the present invention, which are considered as characteristic for the invention, are set forth in the appended claims. The invention itself, however both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENT

Figure 1:
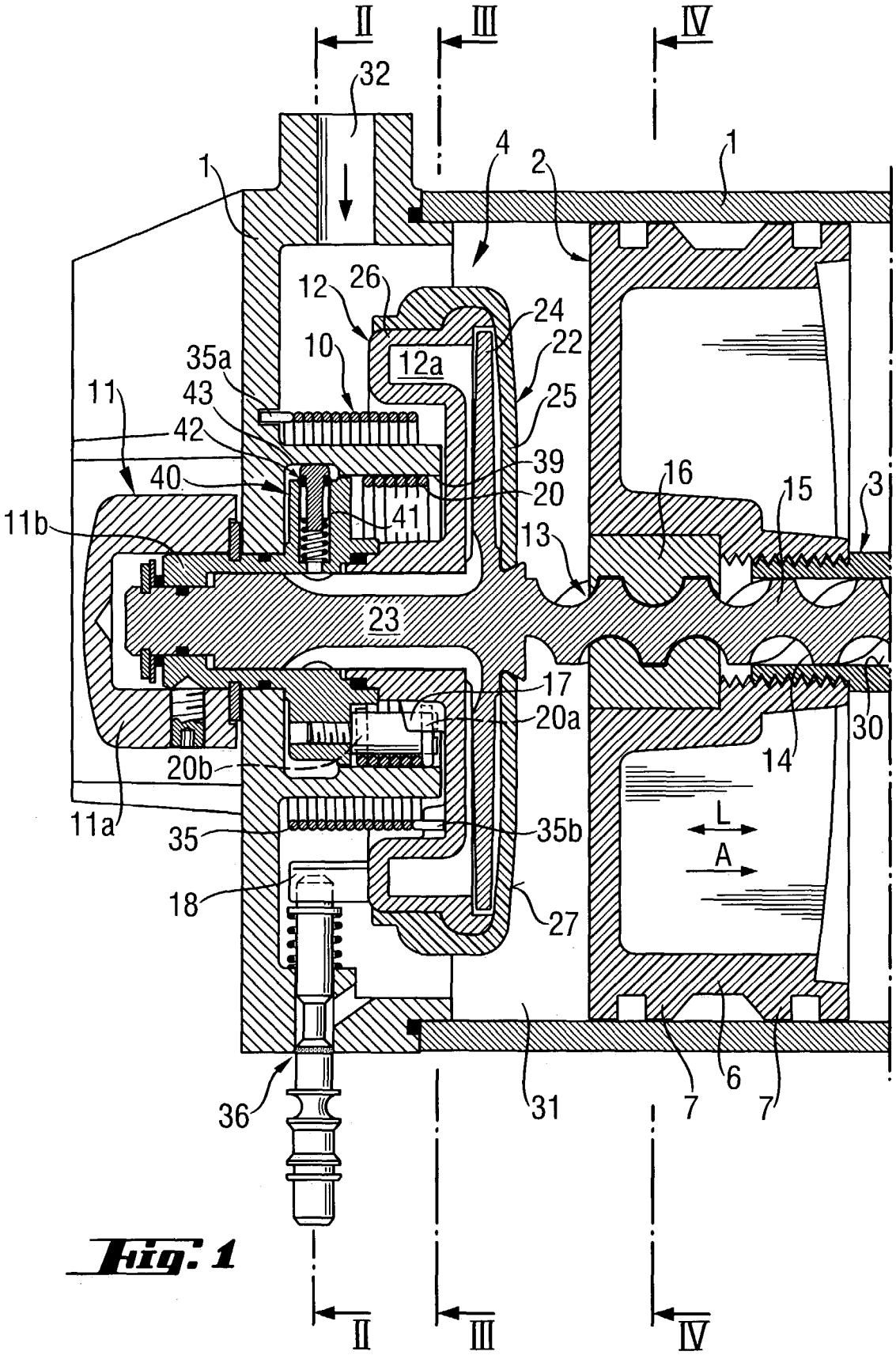
FIG. 1 a longitudinal cross-sectional view of the metering device of a dispenser according to the present invention.
Figure 2:
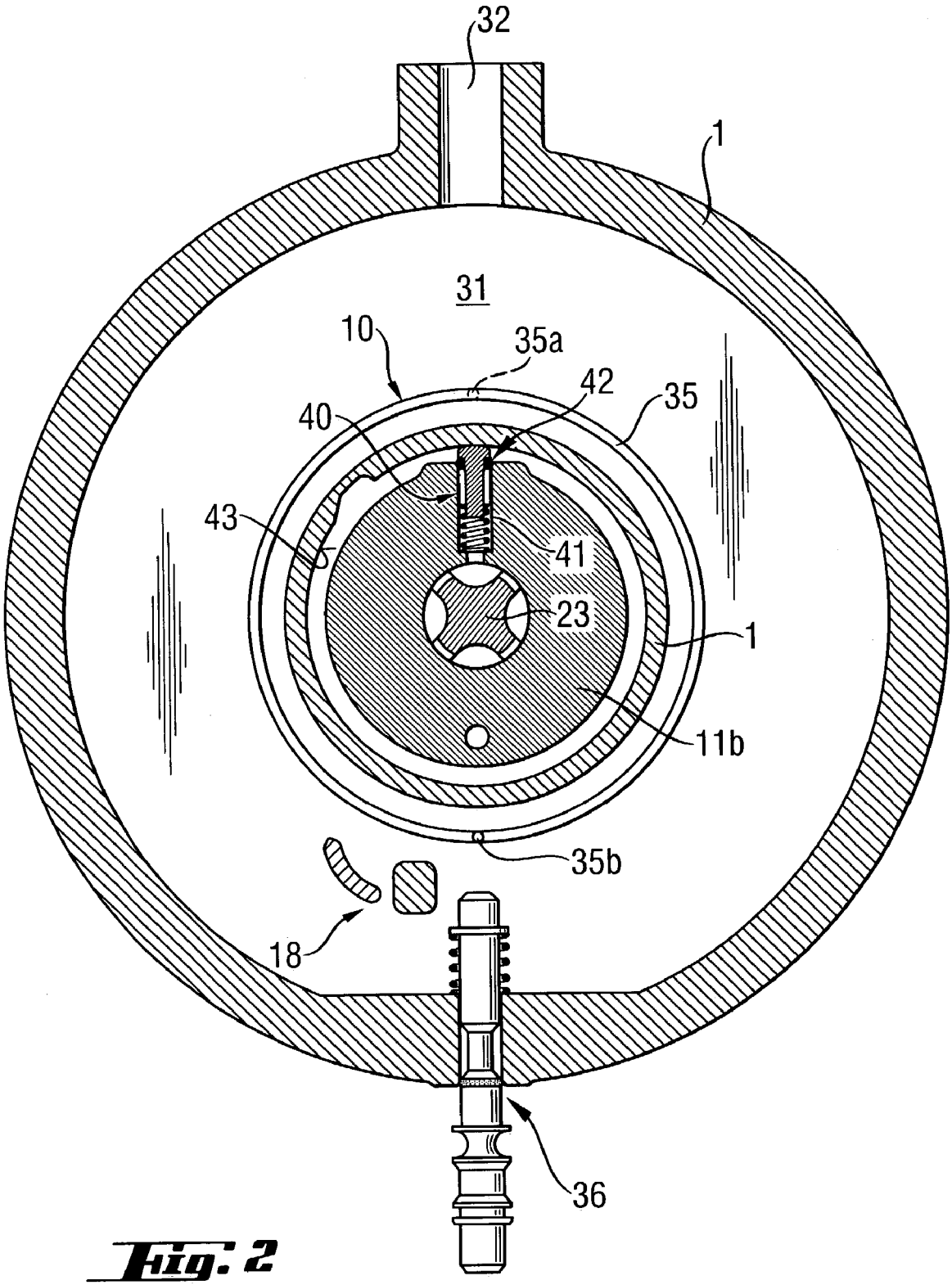
FIG. 2 a cross-sectional view along II—II in FIG. 1.
Figure 3:
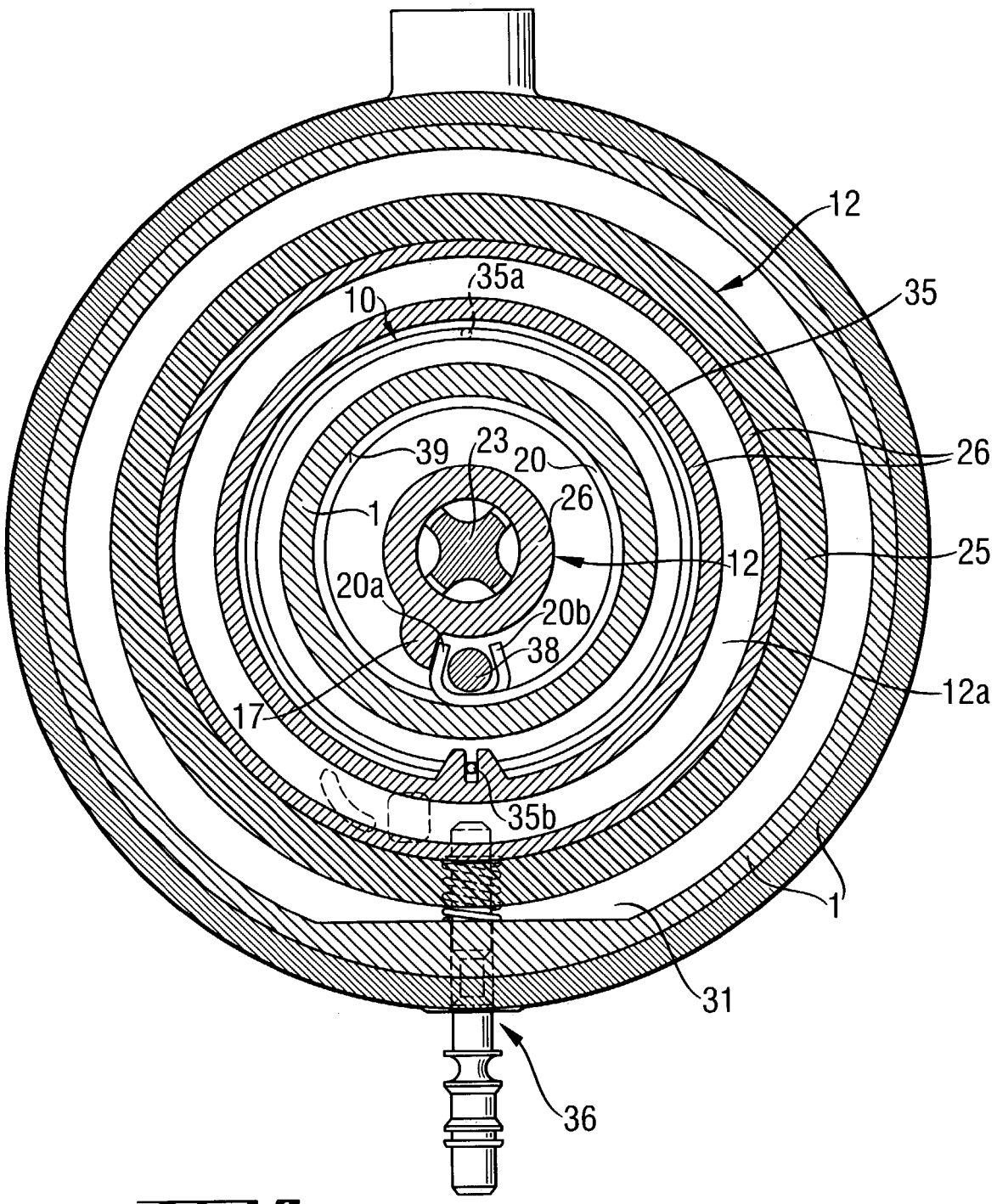
FIG. 3 a cross-sectional view along line III—III in FIG. 1.
Figure 4:
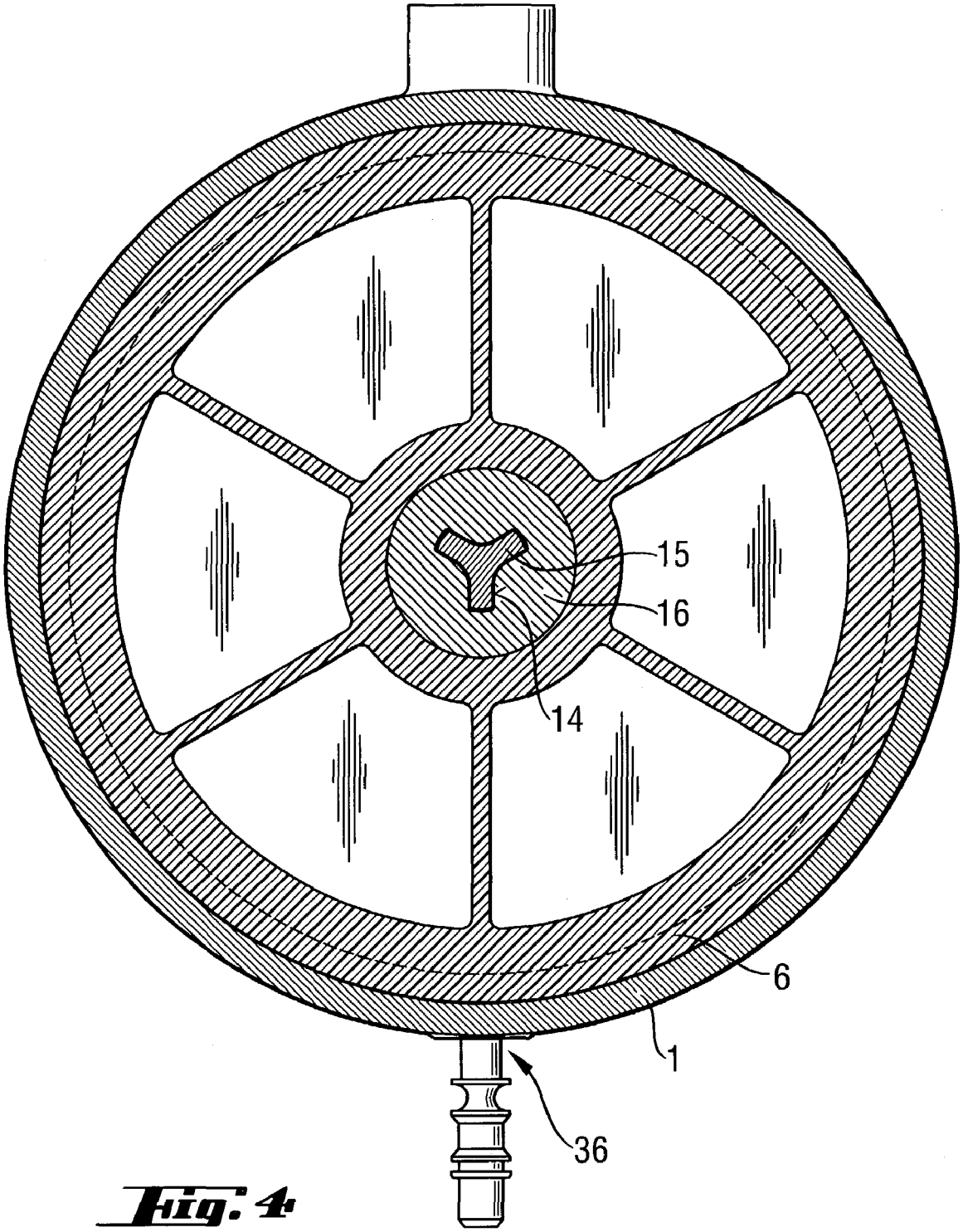
FIG. 4 a cross-sectional view along ling IV—IV in FIG. 1.

A dispenser for dispensing a substance, in particular a pneumatic dispenser, which is shown in FIGS. 1 through 3, includes a housing 1, a dispensing device 2 for storing and delivering a substance and having an elongate press-out member 3, and a metering device 4 for preliminary selecting a metered amount of the substance to be dispensed by the dispensing device 2.

The metering device 4 has a return device 10, an adjustment member 11 for adjusting the metered amount, and an entrain member 12 which cooperates with the press-out member 3 and which is displaced from its end position to its initial position by the return device 10. In order to convert a translational movement of the press-out member 3 in a rotational movement, the metering device 4 further includes a movement converter 13 that in response to movement of the press-out member 3 in the longitudinal direction L, pivots the entrain member 12 relative to the housing 1, i.e., rotates the entrain member 12. The movement converter 13 has a helical shaft 15 with a steep thread 14 and a nut 16 that cooperates with the steep thread 14 and is fixedly secured on the press-out member 3. The pitch of the steep thread 14 is so large that the displacement of the working piston 6 of the press-out member 3 causes the rotation of the helical shaft 15. The rotation or pivoting of the shaft 15 takes place continuously and synchronously with the movement of the working piston in a longitudinal direction. For transmitting of the rotational movement of the helical shaft 15 to the entrain member 12, the metering device 4 includes a compression coupling 22 provided between the press-out member 3 and the entrain member 12. In particular, the compression coupling 22 connects the helical shaft 15 with the entrain member 12. The entrain member 12 has a rest stop 17 and an end stop 18. The end stop 18 provides for actuation of the return device 10, and the rest stop 17 defines the initial position of the entrain member 12. The rest stop 17 and the end stop 18 are rotated relative to each other by the adjustment member 11 and are thereby, adjusted relative to each other. The end stop 18 is provided on the entrain member 12. The rest stop 17 is rotatably supported in the housing 1.

The press-out member 3, which is formed as a piston rod, is displaceable in its longitudinal direction L and is supported in the housing 1 of the dispenser. The working piston 6 is secured at the free end of the press-out member 3, is fixedly connected with the press-out member 3, and has sealing lips 7 provided on its circumference.

The metering device 4 further includes a wrap spring 20 which has a cylindrical outer contour. The wrap spring 20 is located in a bore 39 in the housing 1 and cooperates, as a counter stop, with the rest stop 17. The wrap spring 20 is rotated by the adjusting member 11 and is biased into a contact with the rest stop 17 under action of a tensile load.

In its longitudinal direction L, the press-out member has a central bore 30 for receiving the helical shaft 15 which extends through the nut 16 fixedly secured in the working piston 6 for displacement therewith. A pressure chamber 31, which is provided in the housing 1, adjoins the working piston 6 at the end of the working piston 6 facing in a direction opposite the operational direction A of the working piston 6. An inlet channel 32, which is formed in the wall of the hosing 1, communicates with the pressure chamber 31. Upon creation of overpressure in the pressure chamber 31, e.g., by connecting the pressure chamber 31, via the inlet channel 32, with a pressure source which is actuated by an actuation device (not shown), the generated pressure force displaces the working piston 6 in the operational direction A. The translational movement of the working piston 6 in the operational direction A, i.e., of the press-out member 3, leads to ejection of a substance and, in case the compression coupling is in its engaged condition, to a pivotal movement of the entrain member 12 until the end stop 18 actuates the return device 10.

The return device 10 includes a torsion spring 35 having two free-ends 35*a*, 35*b*. The torsion spring 35 has one of its two ends, the end 35*a*, secured to the housing 1 and has another of its two ends, end 35*b* secured on the entrain member 12. The return device 10 further includes an air exhaust valve 36 for venting the pressure chamber 31.

The compression coupling 22 has a coupling shaft 23 formed as one-piece with the helical shaft 15, a disc-shaped coupling member 24 formed integrally with the coupling shaft 23, and a mating coupling member 25 connectable with the coupling member 24. The mating coupling member 25 is fixedly connected with the entrain member 12 for joint rotation therewith and surrounds the coupling member 24. At its side facing in the operational direction, the mating coupling member 25 has a socket 26 the inner chamber 12*a* of which is separated from the pressure chamber 31. At its side remote from the socket 26, the mating coupling 25 has a diaphragm 27.

In a coupled condition of the compression coupling 22, the mating coupling member 25 is supported on the coupling member 24 for joint rotation therewith. The mating coupling member 25 is sealed from the pressure chamber 31 as a result of the overpressure in the chamber 31, in comparison with the pressure in the inner chamber 12*a*, acting on the mating coupling member 25 and, in particular, on the diaphragm 27, whereby the mating coupling member 25 and, in particular, the diaphragm 27 is frictionally and/or for lockingly pressed against the coupling member 24. This results in that the entrain member 12 becomes fixedly connected with the helical shaft 15 and is rotated jointly therewith. Thereby, the end stop 18, which is fixedly connected with the entrain member 12 for joint rotation therewith, also rotates until it actuates the exhaust air valve 36. Upon actuation of the exhaust air valve 36, the pressure chamber 31 is vented and, as a result, the coupling 22, together with the entrain member 12, are returned to their initial position by the torsion spring 35, whereby the entrain member 12 becomes decoupled from the helical shaft 15.

For adjusting the metered amount, the adjustment member 11 and, in particular, the rest stop 17 are rotated (see FIG. 3). The adjustment member 11, which is formed as a two-part member consisting of a first adjustment part 11*a* and a second adjustment part 11*b*, has a pin member 38, e.g., a holding screw a longitudinal axis of which extends parallel to the longitudinal direction L of the press-out member and which is screwed in the adjustment member 11. The pin 38 is surrounded by the two, bend-out, free ends 20*a*, 20*b* of the wrap spring 20, with a clearance between the respective ends 20*a*, 20*b* and the pin 38. Thereby, upon rotation of the adjustment member 11, the pin 38 is easily screwed in. Because the wrap spring 20 is connected with the adjustment member 11, it rotates upon rotation of the adjustment member 11. When the rotational movement of the adjustment member 11 stops, the substantially cylindrically shaped, wrap spring 20 expands radially outwardly and becomes frictionally or formlockingly secured in the recess 30 of the housing 1. The entrain member 12 is preloaded by the torsion spring 35, which is formed as a return spring, against the wrap spring 20 which forms a counter stop for the return spring, and with the wrap spring 20 contacting the rest stop 17. Upon rotation of the wrap spring 20, the entrain member 12 rotates relative to the housing 1, adjusting the metered amount of the substance.

The rotational position of the adjustment member 11 defines a release position in which the compression coupling 22 is decoupled, whereby the metering device 4 and the metered amount are released. To this end, the metering device 4 includes a release device 40.

The release device 40 includes a cross-bore 41 formed in the adjustment part 11*b* of the adjustment member 11 and extending radially with respect to the longitudinal direction L of the press-out member 3, a release valve 42, and a release cam 43 provided in the housing 1 and cooperating with the release valve 42. Upon rotation of the adjustment member 11 and, in particular, of the second adjustment part 11*b* thereof relative to the housing 1, the release valve 42 is displaced relative to the release cam 43. In the release position, the release cam 43 releases the release valve 42, connecting thereby the inner chamber 12*a*, which is formed by the mating coupling member 25, with the pressure chamber 31. Thereby, the pressure in the inner chamber 12*a* becomes approximately the same as in the pressure chamber 31, which decouples the compression coupling 22. In this position of the compression coupling 22, the displacement of the press-out member 3 does not result in a pivotal movement of the entrain member 12. Advantageously, the adjustment member 11 has only one release position, with the release valve 42 being closed in all of other positions of the adjustment member 11, and with the pressure chamber 31 being separated, as a result, from the inner chamber 12*a* of the mating coupling member 25.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the append claims.

What is claimed is:

1. A dispenser for dispensing a substance, comprising a housing (1); a dispensing device (2) located in the housing (1) and having an elongate press-out member (3) for ejecting the substance and supported in the housing (1) for displacement in a longitudinal direction (L); and a metering device (4) for presetting a metered amount of the substance to be dispensed by the dispensing device (2), the metering device (4) including:

an adjustment member (11) for adjusting the metered amount, an entrain member (12) cooperating with the press-out member (3), a return device (10) for displacing the entrain member from an end position thereof to an initial position thereof, and a movement converter (13) for pivoting the entrain member (12) relative to the housing (1) in response to displacement of the press-out member (3) in the longitudinal direction (L).

2. A dispenser according to claim 1, wherein the movement converter (13) comprises a helical shaft (15), and a nut (16) cooperating with the helical shaft (15) and secured to the press-out member (3).

3. A dispenser according to claim 1, wherein the entrain member (12) has a rest stop (17) defining an initial position of the entrain member (12), and an end stop (18) for actuating the return device (10).

4. A dispenser according to claim 3, wherein the rest stop (17) and the end stop (18) are pivoted relative to each other by the adjustment member (11) for adjusting a relative position therebetween.

5. A dispenser according to claim 3, wherein the end stop (18) is arranged on the entrain member (12).

6. A dispenser according to claim 3, wherein the rest stop (17) is rotatably supported in the housing (1).

7. A dispenser according to claim 3, wherein the metering device (4) further comprises a wrap spring (20) rotatably supported in the housing (1) and rotatable by the adjustment member (11), the wrap spring (20) forming a counter stop cooperating with the rest stop (17).

8. A dispenser according to claim 7, wherein the wrap spring (20) is rotated upon application thereto of a tensile load produced upon rotation of the adjustment member (11).

9. A dispenser according to claim 7, wherein the wrap spring (20) contacts the rest stop (17) under action of a pressure load applied to the wrap spring (20).

10. A dispenser according to claim 1, wherein the movement converter (13) includes a compression coupling (22) arranged between the press-out member (3) and the entrain member (12).

11. A dispenser according to claim 10, wherein the compression coupling (22) has a coupling shaft (23) rotatable in response to displacement of the press-out member (3), a coupling member (24) supported on the coupling shaft (23) for joint rotation therewith, and a mating coupling member (25) connectable with the coupling member (24) and connected with the entrain member (12) for joint rotation therewith.

12. A dispenser according to claim 11, wherein the mating coupling member (25) has a diaphragm (27) engageable, at least regionwise with the coupling member (24) and arranged, at least partially, in a pressure chamber (31) formed in the housing (1).

* * * * *